US006925989B2

(12) United States Patent
Treusch et al.

(10) Patent No.: US 6,925,989 B2
(45) Date of Patent: Aug. 9, 2005

(54) FUEL SYSTEM HAVING PRESSURE PULSATION DAMPING

(75) Inventors: Christopher John Treusch, Saint Clair Shores, MI (US); Joe Zhi Li, Northville, MI (US); Robert Eugene Wattleworth, Canton, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 81 days.

(21) Appl. No.: 10/643,046

(22) Filed: Aug. 18, 2003

(65) Prior Publication Data

US 2005/0039725 A1 Feb. 24, 2005

(51) Int. Cl.[7] ..... F02M 55/02

(52) U.S. Cl. ..... 123/456; 123/467; 123/468; 138/30

(58) Field of Search ..... 123/456, 467, 123/468, 469; 138/26–30

(56) References Cited

U.S. PATENT DOCUMENTS

| | | | | | |
|---|---|---|---|---|---|
| 1,426,009 | A | | 8/1922 | Rantsch | |
| 1,507,012 | A | | 9/1924 | Weier | |
| 1,861,640 | A | | 6/1932 | McCabe | |
| 2,015,430 | A | | 9/1935 | Matthews et al. | |
| 2,259,460 | A | | 10/1941 | Dexter | |
| 2,969,250 | A | | 1/1961 | Kull | |
| 3,665,967 | A | | 5/1972 | Kachnik | |
| 4,056,679 | A | | 11/1977 | Brandt et al. | |
| 4,210,372 | A | | 7/1980 | McGee et al. | |
| 4,651,781 | A | | 3/1987 | Kandelman | |
| 4,660,524 | A | * | 4/1987 | Bertsch et al. | 123/468 |
| 4,838,832 | A | | 6/1989 | Schmitt et al. | |
| 4,897,906 | A | | 2/1990 | Bartholomew | |
| 4,924,584 | A | | 5/1990 | Harney | |
| 5,056,489 | A | * | 10/1991 | Lorraine | 123/468 |
| 5,197,436 | A | * | 3/1993 | Ozawa | 123/456 |
| 5,213,437 | A | | 5/1993 | Sommer | |
| 5,373,824 | A | * | 12/1994 | Peters et al. | 123/527 |
| 5,575,262 | A | | 11/1996 | Rohde | |
| 5,664,655 | A | | 9/1997 | Oh | |
| 5,674,026 | A | | 10/1997 | Ishibashi et al. | |
| 5,697,850 | A | | 12/1997 | Yaegashi et al. | |
| 5,709,248 | A | | 1/1998 | Goloff | |
| 5,752,486 | A | * | 5/1998 | Nakashima et al. | 123/467 |
| 5,884,607 | A | * | 3/1999 | Schiller et al. | 123/467 |
| 6,101,907 | A | | 8/2000 | McGovern et al. | |
| 6,314,942 | B1 | | 11/2001 | Kilgore et al. | |
| 6,354,273 | B1 | * | 3/2002 | Imura et al. | 123/467 |
| 6,390,131 | B1 | | 5/2002 | Kilgore | |
| 6,418,910 | B1 | * | 7/2002 | Nally et al. | 123/456 |
| 6,615,801 | B1 | * | 9/2003 | Zdroik | 123/467 |
| 6,640,783 | B2 | * | 11/2003 | Braun et al. | 123/467 |
| 6,725,839 | B2 | * | 4/2004 | Zdroik et al. | 123/456 |
| 2002/0043249 | A1 | | 4/2002 | Lee et al. | |
| 2002/0053341 | A1 | | 5/2002 | Imura et al. | |

FOREIGN PATENT DOCUMENTS

| | | |
|---|---|---|
| EP | 0780569 | 6/1997 |
| EP | 0785357 | 7/1997 |
| EP | 1162364 | 12/2001 |
| EP | 1188919 | 3/2002 |
| EP | 1199466 | 4/2002 |
| JP | 2001099031 | 4/2001 |
| JP | 2001107821 | 4/2001 |
| JP | 2001207931 | 8/2001 |
| JP | 2001280217 | 10/2001 |

* cited by examiner

*Primary Examiner*—Thomas Moulis
(74) *Attorney, Agent, or Firm*—Brinks Hofer Gilson & Lione

(57) ABSTRACT

The invention relates to a fuel system having pressure pulsation damping. The invention specifically locates restrictors in relation to identified critical elements of the system to control the maximum operating system pulse magnitude, as well as dampening the overall pulsations of the system.

21 Claims, 3 Drawing Sheets

| mm FROM CRITICAL ELEMENT | % OF OPTIMUM |
|---|---|
| 0 | 100% |
| 44 | 90% |
| 88 | 80% |
| 133 | 70% |
| 177 | 60% |
| 221 | 50% |
| 265 | 40% |
| 310 | 30% |
| 354 | 20% |
| 398 | 10% |
| 442 | 0% |

FUEL SYSTEM HAVING PRESSURE PULSATION DAMPING

BACKGROUND

1. Field of Invention

The present invention relates generally to fuel pressure pulsation damping systems, and more particularly to a fuel pressure pulsation damping system with reduced pulsation magnitudes at resonate modes of the fuel deliver system.

2. Description of the Known Technology

Conventional methods of damping pressure pulsations in a fuel system rely solely on inclusion of a member that introduces more compliance (a "compliance member"), thereby reducing the bulk modulus of the system. This can be accomplished through the use of a conventional fuel pressure damper, an internal damper or inherent/self-damping, the latter being where a member of the fuel delivery system in fluid communication with the pulsating fuel is provided with a flexible wall or walls to absorb the pressure fluctuations within the system. The location of these compliance members generally are governed solely by manufacturing and packaging concerns.

Simply adding compliance is not always sufficient to relieve all of the objectionable pressure pulsations in the fuel delivery system however. It can also result in unwanted variation in the fuel injector performance as well as objectionable noise, vibration and harshness. In some systems where adding sufficient compliance is possible, it may not be commercially feasible or physically practical to introduce a custom designed compliant damping system. The additional compliance may make certain members too weak to function properly or require expensive materials to achieve the desired effect.

Resolving these resonant frequency issues simply by adding more compliance can result in other unwanted effects. Adding more compliance may allow more pulsations to be absorbed, but it will also result in a shift in frequency of resonant modes of the system. As compliance is increased, the frequency of resonant modes of the system shift to lower frequencies. When the frequency of the modes shift lower, higher resonant modes that were previously above the operating frequency range of the fuel system (and thus previously not a problem) may shift into the operating frequency range of the fuel system. Therefore, adding more compliance can sometimes result in more objectionable resonant frequency modes than before.

It remains desirable to provide a means of damping objectionable pressure pulsations to thereby limit the maximum operating system pulse magnitude, other than by merely adding compliance.

SUMMARY

The present invention overcomes the disadvantages of the known technology by including one or more restrictors within identified critical elements of a fuel rail to increase the damping ratio of the resonant mode, and thereby achieve the desired damping of pressure fluctuations. A problem arises when the operating frequency excites one of various resonant modes of the system. From this resonant mode, it can be determined which elements of the fuel delivery system contribute most to the resonant mode. Such an element can be a distinct component of the fuel delivery system, such as a jumper tube between two sides of a fuel rail assembly or it can be a significant structure for resonant modes within a component, such as a long straight section of pipe between two injector ports, integrated into a larger component of the fuel rail. At the frequencies where some of these resonant modes are excited, the maximum operating system pulse magnitude can increase to several times normal operating levels. Such resonant modes and the associated system elements are herein referred to as the critical modes and critical elements.

According to the present invention, a restrictor is located within, or in proximity to, an identified critical element or elements that would otherwise contribute significantly to critical resonant modes, which cause pressure pulsations above a specified level within the operating frequency range of the system. These restrictors serve to increase the damping ratio of the critical modes, and thereby dampen the system sufficiently to reduce maximum operating pulse magnitudes below a specified level required in the given application.

It is an object and advantage that the present invention results in avoiding objectionable pressure fluctuations in a fuel system.

It is an additional object and advantage that the present invention results in limiting maximum operating system pulse magnitudes, without introducing additional resonant modes into the operating frequency range of the fuel system.

These and other advantages, features and objects of the invention will become apparent from the drawings, detailed description and claims, which follow.

DETAILED DESCRIPTION OF THE INVENTION

Figure 1:
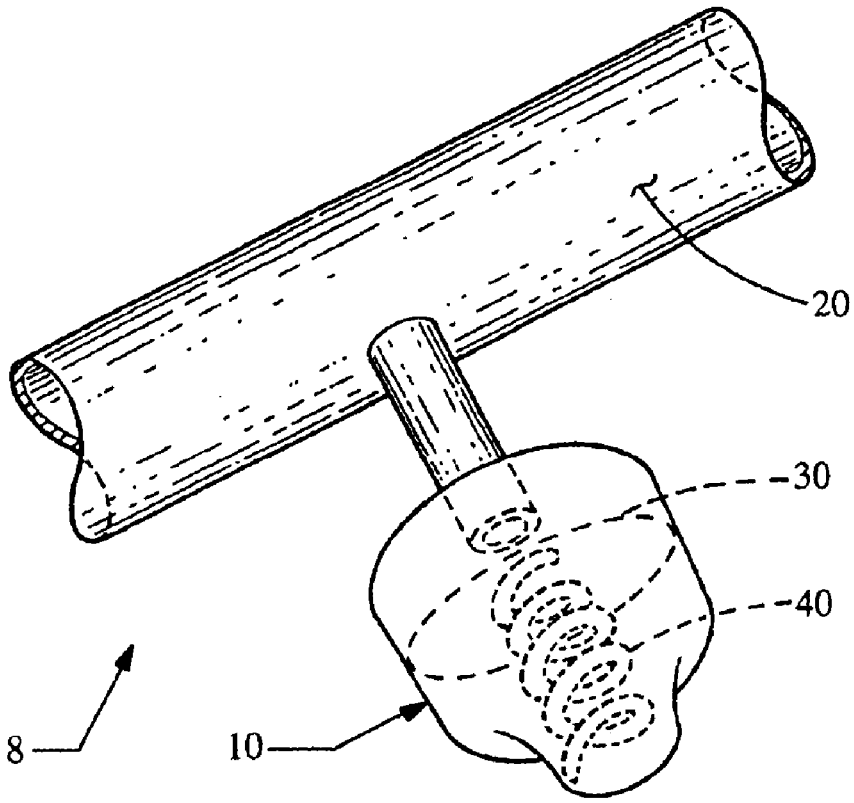
Fig. 1 Prior Art
FIG. 1 is a view of a prior art fuel system with a conventional compliance damper.

Referring now to the drawings, FIG. 1 illustrates a conventional pressure pulsation damping system 8, such as used in a fuel system. Pressure pulsations in fuel systems result from inputs and outputs of the system. These pressure pulsations can add unwanted pressure fluctuations at the fuel injector, thus reducing predictability of injector operation and affecting the ability of the engine's powertrain control module to predict and control emissions and performance. In order to design an efficient powertrain control system, many automotive manufacturers will specify a maximum pulse magnitude that the fuel system should not operate beyond.

At particular rpm and loads within the operating range of the vehicle and fuel system, the pressure spikes and the fuel pressure can reach magnitudes in excess of ten times that experienced during other periods of operation. These large pressure magnitudes in turn can create objectionable noise, vibration and harshness in the fuel system or exceed the specified maximum pressure pulse magnitude. Engineers thus need to develop systems that must operate in specific operational ranges with a design that avoids major pressure pulses in the system. These large magnitude pressure spikes are dependent on and differ based on specific designs.

Often, dampers 10 will be added to dampen out the objectionable pulsations. The addition or modification of a damper 10 can alter the resonant modes of the system 8 however, sometimes moving a resonant mode that previously existed beyond the operating frequency range into the operating frequency range. Engineers can find themselves iteratively changing dampers 10 in an attempt to find the best compromise.

Pressure fluctuations in the fuel are put into the system 8 by the fuel pump, pressure release caused by firing injectors on the output side, and the interaction of these inputs and outputs among the elements of the fuel system 8. In a conventional system 8, the damper 10 is in fluid communication with the fluid passage 20 to absorb fuel pressure pulsations. In some systems, this damper can be as elementary as a thin wall in one of the fuel system components that flexes in response to pressure increases. In more complicated systems discrete dampers, such as the one illustrated, include a flexible diaphragm 30 is supported by a spring or other means 40 to absorb pulsation energy in the fluid passage 20. Still further examples of damping systems include providing an internal damper in the fuel rail and providing the fuel rail/system with inherent or self-damping via the incorporation of flexible wall elements in the system.

As mentioned above, dampers are often developed and positioned in an iterative process with little regard to the interaction of the various components in how they function to reduce pressure fluctuations. Often more compliance elements are introduced in conventional systems to absorb energy and thus reduce the pulsations and their undesirable effects. However, such more compliance in the system can create other problems as mentioned above. The present invention overcomes such problems.

When a fuel system is swept or run through the rpm range over which it will be expected to operate, pressure spikes of magnitudes beyond acceptable design specifications can be identified. By conducting an FFT analysis on a given pressure spike, a frequency can be determined that primarily contributes to that spike. This is herein referred to as the "critical frequency". From the critical frequency, the resonant mode associated with the pressure spike can be identified. This is referred to herein as the "critical mode". Often more than one pressure spike in the rpm sweep is due to a single critical mode. Using a shape modal analysis, an element(s) of the fuel system that contributes most to the critical mode can be identified. This element(s) is referred to herein as the "critical element(s)".

The inventors have discovered that identifying the critical element and locating a restrictor in the critical element will substantially increase the damping ratio of the critical mode, resulting in a maximum reduction in the pressure spike(s) associated therewith. The inventors have further discovered that the restrictor may even be located outside of the critical element, in the proximity of the critical element, resulting in an acceptable reduction in the magnitude of the pressure spike, to levels of acceptability for the given design and application.

Figure 2:
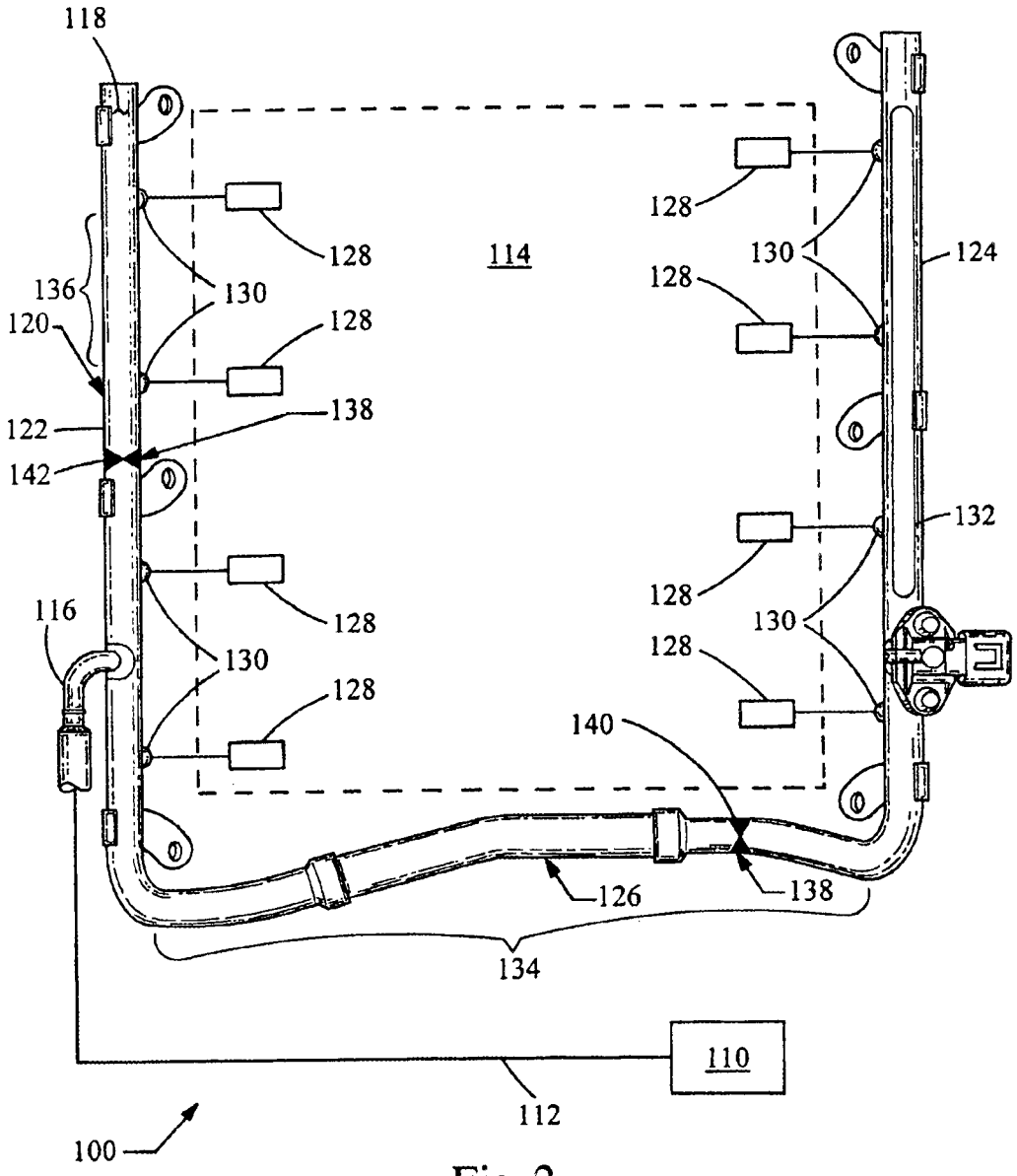
FIG. 2 is a view of a fuel system with a restrictor located in or in proximity to a critical element.

Referring now to FIG. 2 seen therein is a fuel system 100. The illustrated system 100 provides fuel from a fuel tank 110, via a chassis line 112, to an internal combustion engine 114. From the chassis line 112, fuel is delivered via an infeed 116 into the internal passageway 118 of a fuel rail 120. The fuel rail 120 may be one of the many known designs, such as the illustrated dual rail system having a first side rail 122 and a second side rail 124. The two side rails 122, 124 are connected by a cross-over rail 126. Connected to the first and second side rails 122, 124 are a plurality of fuel injectors 128, connected via injector cups 130. The fuel rail 120 is also provided with a compliance member 132, illustrated as an internal damper, that increases the bulk modulus of the system 100.

As mentioned above, one or more critical elements 134 can be defined within the system 100. It should be noted that the critical element(s) 134 may be a discrete part of the fuel system 100, such as the cross-over rail 126, or it may be a portion of the system 100, such as a section of one of the side rails 122, 124 between two or tire fuel injectors 128.

Two critical members 134, 136 are shown, for illustrative purposes, in the system 100. The first critical member 134 is identified as the cross-over rail 126, while the second critical member 136 is identified as a section of the first side rail 122 between two of the fuel injectors 128.

A restrictor 138 is located in relation to the critical element 134, 136 in order to reduce the maximum operating pulse magnitude contributed by that critical element 134, 136. It should be pointed out that all systems contain inherent compliance as a result of component material, component design and configuration. Some designs incorporate the damping function into the fuel rail wall design. This built-in compliance can sometimes meet all of the required compliance needed by the system. In these cases, there may not be a discrete damper, as other system components provide this function. By locating the restrictor 138 in the correct relation to an identified critical element 134, 136, one can increase the damping ratio and thereby reduce the maximum operating system pulse magnitude, without introducing new and unwanted other resonant modes.

In FIG. 2, two critical elements 134, 136 are identified, respectively the cross-over rail 126 and a section of the first side rail 122. As mentioned above, by locating a restrictor anywhere in the critical element itself, the maximum possible benefit is gained. In other words, the magnitude of the pressure spike will be reduced by the maximum amount. This is seen with regard to the critical element 134 and the location of a restrictor 140 within the critical element 134 itself.

Optimum restrictor location may not always be possible or practical because of packaging or other constraints. Locating a restrictor in a less than optimum position may sail serve to adequately reduce the maximum operating system pulse magnitude below that specified by design criteria. In such instances, locating the restrictor in proximity to the critical element may achieve sufficient benefits in terms of magnitude reduction so as to reduce the magnitude of the pressure spike to within acceptable design criteria. This is seen with regard to the critical element 136 and the location of a restrictor 142 in proximity to the critical element 136 itself. In such instance only a percentage of the optimal benefit, the benefit gained by placing the restrictor within the critical element, will be achieved.

Figure 3:
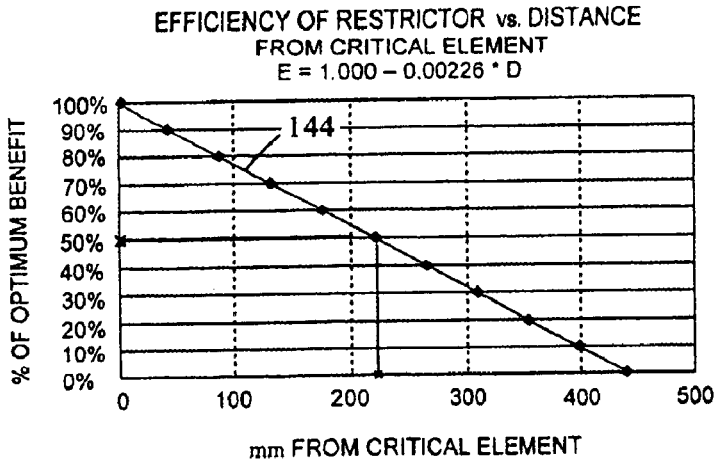
FIG. 3 is a graph and table illustrating the relationship between efficiency and the distance from the critical element of the restrictor.

The effectiveness of the restrictor can be represented by a linear function of the distance from the optimum location to the restrictor. In general, the efficiency of a restrictor location compared to an optimally placed one can be generally represented by the equation $E=1.000-0.00226\times D$, where E is the efficiency and D is the distance from the end of the critical element (in millimeters). Represented in another way, $D=(1.00-E)/0.00226$. FIG. 3 shows the relationship of performance or efficiency of a restrictor, defined as the percent of optimal benefit, to its location from the end point of a critical element. As defined herein, this distance from the critical element is measured from the end point of the critical element to the location of the restrictor. From the line 144 of FIG. 3 it is seen that a substantially linear relationship exists between the percent of optimal benefit gained and the distance at which the restrictor is located from the critical element.

With the restrictor located in proximity to the critical element, the maximum operating pulse magnitude caused by the particular critical element is lowered. The effect that the restrictor has on reducing the maximum operating pulse magnitude may lower the magnitude of the operating pulse to within the requirements of the specified maximum operating pulse magnitude for a system. In such a case, optimum placement of the restrictor is not a requirement, and the restrictor may be positioned some distance from the end point of the critical element. Rewriting the efficiency term E of the prior equation, the allowable distance that a restrictor can be moved from the end point of a critical element can be substantially expressed by the equation $D=(1.000-[R_r/R_a]/0.00226$, where $R_r$ is the required effect on the maximum pulse magnitude and $R_a$ is the actual effect on pulse magnitude caused by the restrictor. Thus, if an optimum restrictor (located within (zero millimeters from) the critical element) reduces the actual maximum operating system pulse magnitude, $R_a$, by a factor of 4, and the specified or required maximum operating system pulse magnitude, $R_r$, is twice as large, the system can afford a 50% efficiency in the placement of the restrictor. From the graph and table of FIG. 3, it can be seen that the restrictor should be within 221 mm of the end point of the critical element.

While the above first order equations yields very good results in predicting percent of optimum benefit gained, an inspection of the graph in FIG. 3 reveals that data to be slightly non-linear. A non-linear analysis yields a slightly improved mathematical model, a second order equation, of the data. Accordingly, the efficiency of a restrictor location compared to an optimally placed one can be further defined by the equation $E=1.00066-0.00107663(D)-0.00000699496(D^2)$.

Figure 4:
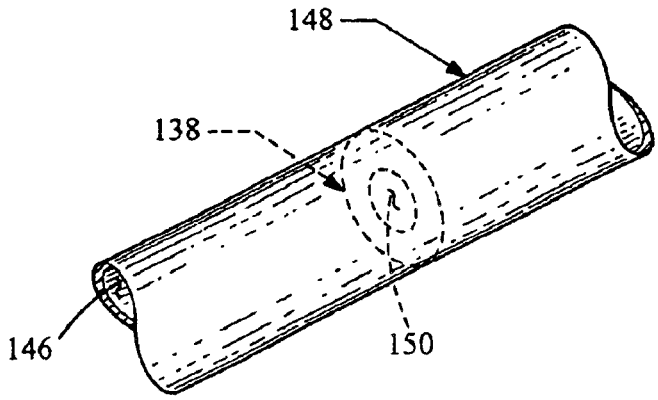
FIG. 4 is an illustration of a restrictor as may be employed with the present invention.

Referring now to FIG. 4, illustrated therein is one embodiment of a restrictor 138 as may be employed with the present invention. The restrictor 138 is illustrated as being located with an internal passageway 146 of a fuel rail 148. The restrictor 138 defines a reduced diameter orifice or passageway 150 within the internal passageway 146 of the fuel rail 148. Restrictors as utilized with the present invention may be of numerous designs and constructions. Some of such designs and constructions are detailed in U.S. patent application Ser. No. 10/342,030 filed on Jan. 14, 2003, which is hereby incorporated by reference.

While the invention has been described with regard to fuel systems, it is anticipated that the invention will have applicability to hydraulic systems in general where pressure pulsations need to be reduced.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A fuel delivery system for an internal combustion engine, said system having fuel pressure damping and comprising:

a fuel feed line;

a fuel rail defining a fuel passageway therein, said rail being connected to said feed line to receive fuel from said feed line into said passageway;

a plurality of fuel injectors connected to said rail to receive fuel from said passageway to be delivered to the engine;

a compliance member located within said system, said compliant member decreasing the bulk modulus of said system;

at least a portion of said system defining a critical element of said system, said critical element significantly contributing to a resonant mode of said system during operation wherein a pressure pulsation occurs within said system; and a fluid flow restrictor located within said system, said restrictor being located in relation to said critical element whereby the distance (C) from said restrictor to an end of said critical element is generally defined by the equation $D=(1-E)/0.00226$, where E is the percent optimal benefit gained.

2. The fuel delivery system of claim 1 wherein said restrictor is located within said critical element.

3. The fuel delivery system of claim 1 wherein said restrictor is located in proximity to said critical element.

4. The fuel delivery system of claim 1 wherein said restrictor is located less than 422 mm from said critical element.

5. The fuel delivery system of claim 1 wherein said critical element is a portion of said rail.

6. The fuel delivery system of claim 1 wherein said rail includes a cross-over member located between first and second side rails.

7. The fuel delivery system of claim 6 wherein said critical element is a portion of said crossover member.

8. The fuel delivery system of claim 6 wherein said critical member is a portion of one of said first and second side rails.

9. A fuel delivery system for an Internal combustion engine, said system having fuel pressure damping and comprising:

a fuel feed line;

a fuel rail defining a fuel passageway therein, said rail being connected to said feed line to receive fuel from said feed line into said passageway;

a plurality of fuel injectors connected to said rail to receive fuel from said passageway to be delivered to the engine;

a compliance member located within said system, said compliant member decreasing the bulk modulus of said system;

at least a portion of said system defining a critical element of said system, said critical element significantly contributing to a resonant mode of said system during operation wherein a pressure pulsation occurs within said system; and a fluid flow restrictor located within said system, said restrictor being located in relation to said critical element whereby the distance (D) from said restrictor to an end of said critical element is generally defined by the equation $D=(1-[R_r/R_a])/0.00226$, where $R_r$ is the required effect on the maximum pulse magnitude and R is the actual effect on the pulse magnitude.

10. The fuel delivery system of claim 9 wherein said restrictor is located within said critical element.

11. The fuel delivery system of claim 9 wherein said restrictor is located in proximity to said critical element.

12. The fuel delivery system of claim 9 wherein said restrictor is located less than 422 mm from said critical element.

13. The fuel delivery system of claim 9 wherein said critical element is a portion of said rail.

14. The fuel delivery system of claim 9 wherein said rail includes a cross-over member located between first and second side rails.

15. The fuel delivery system of claim 14 wherein said critical element is a portion of said cross-over member.

16. The fuel delivery system of claim 14 wherein said critical member is a portion of one of said first and second side rails.

17. A fuel delivery system for an internal combustion engine, said system having fuel pressure damping and comprising:

a fuel food line;

a fuel rail defining a fuel passageway therein, said rail being connected to said feed line to receive fuel from said feed line into said passageway;

a plurality of fuel injectors connected to said rail to receive fuel from said passageway to be delivered to the engine;

a compliance member located within said system, said compliant member decreasing the bulk modulus of said system;

at least a portion of said system defining a critical element of said system, said critical element significantly contributing to a resonant mode of said system during operation wherein a pressure pulsation occurs within said system of a magnitude beyond a predetermined limit; and a fluid flow restrictor located within said system, said restrictor being located in relation to said critical element whereby the distance (D) from said restrictor to an end of said critical element results in a percent optimal benefit gained (E) that reduces the magnitude of the pressure pulsation to within the predetermined limit.

18. The fuel delivery system of claim 17 wherein raid restrictor is located within said critical element.

19. The fuel delivery system of claim 17 wherein said restrictor is located in proximity to said critical element.

20. The fuel delivery system of claim 17 wherein the distance (D) is generally defined by the equation $D=(1-E)/0.00226$, where E is the percent optimal benefit gained.

21. The fuel delivery system of claim 17 wherein the percent optimal benefit gained (E) is generally defined by the equation $E=1.00066-0.00107663(D)-0.00000699496(D^2)$.

* * * * *